US006581793B1

(12) United States Patent
Racine et al.

(10) Patent No.: US 6,581,793 B1
(45) Date of Patent: Jun. 24, 2003

(54) CAP WITH FLUID SEAL

(75) Inventors: JeanPatrice Racine, Trevoux (FR); Michel Luzzato, Lyons (FR); Alain Franchet, Luxembourg (LU)

(73) Assignee: Novembal, Levallois Perret (FR)

( * ) Notice: Subject to any disclaimer, the term of this patent is extended or adjusted under 35 U.S.C. 154(b) by 0 days.

(21) Appl. No.: 09/787,283

(22) PCT Filed: Sep. 15, 1999

(86) PCT No.: PCT/FR99/02195

§ 371 (c)(1),
(2), (4) Date: Mar. 15, 2001

(87) PCT Pub. No.: WO00/15517

PCT Pub. Date: Mar. 23, 2000

(30) Foreign Application Priority Data

Sep. 16, 1998 (FR) ..... 98 11569

(51) Int. Cl.[7] ..... B65D 53/00

(52) U.S. Cl. ..... 215/350; 215/252; 215/258; 215/343; 215/341

(58) Field of Search ..... 215/252, 258, 215/341–343, 349, 350, 351; 264/268

(56) References Cited

U.S. PATENT DOCUMENTS

| | | | | |
|---|---|---|---|---|
| 2,681,742 A | | 6/1954 | Miller | |
| 3,215,297 A | * | 11/1965 | Acton et al. | 215/334 |
| 3,428,208 A | * | 2/1969 | Kosar | 215/341 |
| 3,503,534 A | * | 3/1970 | Moller | 215/351 |
| 4,379,512 A | * | 4/1983 | Ohmi et al. | 215/343 |
| 4,386,712 A | * | 6/1983 | DeWallace | 215/350 |
| 4,682,704 A | * | 7/1987 | Kessler et al. | 215/329 |
| 4,694,970 A | * | 9/1987 | Hayes | 215/252 |
| 5,176,271 A | * | 1/1993 | Painchaud et al. | 215/350 |
| 5,257,705 A | * | 11/1993 | de Santana | 215/252 |
| 5,346,082 A | * | 9/1994 | Ochs et al. | 215/350 |
| 5,358,131 A | * | 10/1994 | McCandless et al. | 215/252 |
| 5,421,470 A | * | 6/1995 | Dudzik | 215/343 |
| 5,676,269 A | * | 10/1997 | Blake et al. | 215/252 |
| 5,725,116 A | * | 3/1998 | Takai | 215/252 |
| 5,829,608 A | | 11/1998 | Clerget | |
| 5,913,436 A | * | 6/1999 | Breuer | 215/252 |

FOREIGN PATENT DOCUMENTS

| | | | | |
|---|---|---|---|---|
| CH | 597052 | * | 3/1978 | 215/350 |
| DE | 197 33 636 A1 | * | 2/1999 | |
| EP | 900742 | | 3/1999 | |
| FR | 1197452 | | 12/1959 | |
| FR | 2721677 | | 12/1995 | |
| GB | 741856 | * | 12/1955 | 215/351 |
| GB | 1364243 | * | 8/1974 | 215/350 |
| WO | 8706914 | | 11/1987 | |

* cited by examiner

*Primary Examiner*—Robin Hylton
(74) *Attorney, Agent, or Firm*—Dowell & Dowell, P.C.

(57) ABSTRACT

A cap adapted to be secured on a neck of a container wherein the cap includes a top wall and a depending annular skirt having an inner annular projection. A fluid seal having a central transverse wall, an outer annular shoulder and a inner annular bead rests on the inner annular projection so as to define a space between the cap and the fluid seal into which the fluid seal is pushed when the cap is secured to the neck of the container to make a seal between the outer annular shoulder of the seal and the inner annular projection.

15 Claims, 6 Drawing Sheets

CAP WITH FLUID SEAL

BACKGROUND OF THE INVENTION

1. Field of the Invention

The invention relates to a cap with fluid seal, to a process for making such a cap and, finally, to an assembly comprising a container for certain contents and the cap with fluid seal in question.

2. The Related Art

Caps made of sufficiently rigid plastics material are already known, of the type comprising, on the one hand, a transverse wall and an adjoining annular skirt internally provided with screw threads and, on the other hand, an inner annular projection projecting from the inner face of the skirt in the vicinity of the transverse wall. It is known that such a projection may have the function of participating in the maintenance of a fluid seal.

Fluid seals made of plastics material capable of being elastically deformed are also known, of the type comprising, on the one hand, an elastically deformable peripheral bead and, on the other hand, a transverse wall on the periphery of which the bead is located. Such a fluid seal may form part of a cap being maintained by means of the inner annular projection with which the latter is provideed. In such an embodiment, the peripheral bead of the seal may cooperate with the edge of the neck of the container in order to ensure a tight closure.

Moreover, caps such as those mentioned hereinabove are known, which further comprise a tamperproof ring adjoining the free edge of the skirt opposite the transverse wall, the connection between the skirt and the tamperproof ring being of lesser resistance in order to be able to be fractured when the cap is first opened, the tamperproof ring further comprising, towards the inside, means adapted to interfere with a corresponding annular projection provided on the neck of the container.

Reference may be made in particular to documents EP-A-637 550, GB-A-2 092 999, WO-A-94-18084, FR-A-2 709 473, FR-A-2 692 555, FR-A-2 711 969 and, finally, FR-A-2 454 568.

Generally, the sealing means that the caps comprise belong to one of the following three families:

- the one where the sealing means are integrated in the cap itself, designed accordingly;
- the one where the fluid seal is made in situ, in the cap itself;
- and, finally, the one where the fluid seal made previously elsewhere, is added in the cap.

SUMMARY OF THE INVENTION

The invention concerns this third and last family and not the first two, which have their specificities and their own constraints. An example of cap belonging to this third family is known from FR-A-2 721 677 which discloses a cap comprising a fluid seal mounted floating and provided with an annular boss which maintains its transverse wall at a distance form the bottom of the cap.

Consequently, the invention aims at producing a cap with added fluid seal in which the seal is made efficiently while the positioning of the cap, in added manner, is effected conveniently.

More particularly, the invention aims at producing a cap with added seal moulded shouldered but floating, as is described.

Furthermore, the invention aims at a plurality of maximum embodiment with considerable suppleness and facility of implementation.

In effect, a seal as provided here may be mounted on different types of cap shells whose internal shape is adapted. Furthermore, these shells may, depending on the cases, receive an added seal as described or a seal made in situ.

According to a first aspect, the invention relates to a cap with fluid seal, in which:

- the cap proper, made of sufficiently rigid plastics material, comprises, on the one hand, a transverse wall and an adjoining annular cylindrical skirt provided internally with screw threads intended to cooperate with complementary screw threads on the neck of a container, on the other hand, an internal annular projection projecting from the inner face of the skirt in the vicinity of the transverse wall, this projection having the function of participating in the maintenance of a fluid seal;
- the fluid seal, made of plastics material capable of being elastically deformed, comprises in the first place an elastically deformable peripheral bead with which the edge of the neck of the container can cooperate for the seal, in the second place a transverse wall on the periphery of which the bead is located, and in the third place a supple annular shoulder for maintaining the seal, cooperating with the annular projection of the cap proper;
- the fluid seal, when it is made, is added in the cap and maintained floating by means of the inner annular projection cooperating with the shoulder so that there is formed between the inner face of the transverse wall of the cap and the opposite face of the fluid seal a space of generally flattened cylindrical shape in which the seal may be housed once the cap with fluid seal is mounted and tightened on the neck of the container.

At rest, the fluid seal is limited on the side of the transverse wall of the cap by a substantially planar face. The bead projects on the side of the opposite face of the seal which is intended to face towards the neck of the container. The supple annular shoulder outwardly surrounds the bead and is disposed in line with the transverse wall of the seal. This shoulder is intended to cooperate with the inner annular projection of the cap in order to ensure maintenance of the fluid seal, the latter thus being maintained in shouldered and floating manner. This shoulder presents a suppleness and an axial thickness adapted to allow easy assembly with a view to efficient maintenance of the seal in the cap proper.

When the fluid seal is mounted in the cap and at rest, the face or the projecting free edge of the bead opposite the transverse face of the seal is disposed substantially in the plane of the face or the projecting free edge of the inner annular projection of the cap.

The space between the cap and the fluid seal is such that it is adapted, on the one hand, to allow the appropriate deformation of the fluid seal further to the assembly and tightening of the cap provided with the seal on the neck of the container. On the other hand, this space is adapted to allow the application and abutment of the seal against the inner face of the cap, once the latter is mounted and tightened on the neck of the container.

The bead presents, in traverse cross section, a profile generally in the form of a V or a U, or W or pseudo V—in particular with truncated or rounded apex—, or pseudo U, or pseudo W.

In one embodiment, the bead is outwardly limited by a substantially truncated or cylindrical face corresponding substantially to the narrowed opening formed by the inner projection of the cap. The bead is inwardly limited by a substantially truncated face of which the diameter nearest the transverse wall of the seal is the small diameter while the large diameter is intended to face towards the neck of the container.

According to to one embodiment, the fluid seal also comprises a second annular bead placed inside the first and slightly spaced apart therefrom radially.

The inner projection of the cap presents, in transverse cross section, the general shape of a V, or a U, or a pseudo V—particularly with truncated apex—, or pseudo U, upturned, comprising an arm substantially transverse with respect to the principal axis of the cap and an arm slightly inclined on this axis.

According to an embodiment, the cap, with fluid seal which has just been described, further comprises a tamperproof ring adjoining the free edge of the skirt opposite the transverse wall. The connection between the skirt and the tamperproof ring—by bridges, cut-outs, a smaller thickness or other—is of lesser resistance in order to be able to be fractured when the cap is first opened. In addition, the tamperproof ring inwardly comprises projecting means adapted to interfere with a corresponding annular projection provided on the neck of the container. These projecting means are, according to their embodiments, a bead, one or more tabs, one or more projections or otherwise.

Such a cap with fluid seal and tamperproof ring may form the subject matter of different variant embodiments. According to a first variant, the tamperproof ring itself is transversely breakable at at least one place and opens when the cap is first opened. According to another variant, the ring is not transversely breakable.

When the ring is breakable, it may be connected to the skirt by at least one non-frangible connection or, on the contrary, may not comprise such a non-frangible connection.

According to another aspect, the invention relates to a process for producing a cap as has just been described. In this process, the cap and the fluid seal are firstly made separately by injection, compression or otherwise. Then the fluid seal is positioned and associated in and with the cap, forcing the seal to pass beyond the inner projection of the cap. This operation is rendered possible further to the shape and constitution of the shoulder combined with the shape of the cap proper. The seal is then maintained shouldered but floating in the cap.

According to a last aspect, the invention concerns an assembly comprising, on the one hand, a container for certain contents, this container being provided with a neck with an outer threading and, as the case may be, with an annular projection intended to cooperate with a tamperproof ring. The assembly comprises, on the other hand, a cap with fluid seal as has just been described. This cap with seal is mounted and tightened on the neck of the container. With respect to the situation where it is at rest, the fluid seal is deformed in order to be applied in abutment on the inner face of the cap, the bead being crushed and deformed by the free end part of the neck of the container.

BRIEF DESCRIPTION OF THE DRAWINGS

Other advantages and characteristics of the invention will result from the following description with reference to the accompanying drawings, in which.

DESCRIPTION OF THE PREFERRED EMBODIMENTS

Figure 1:
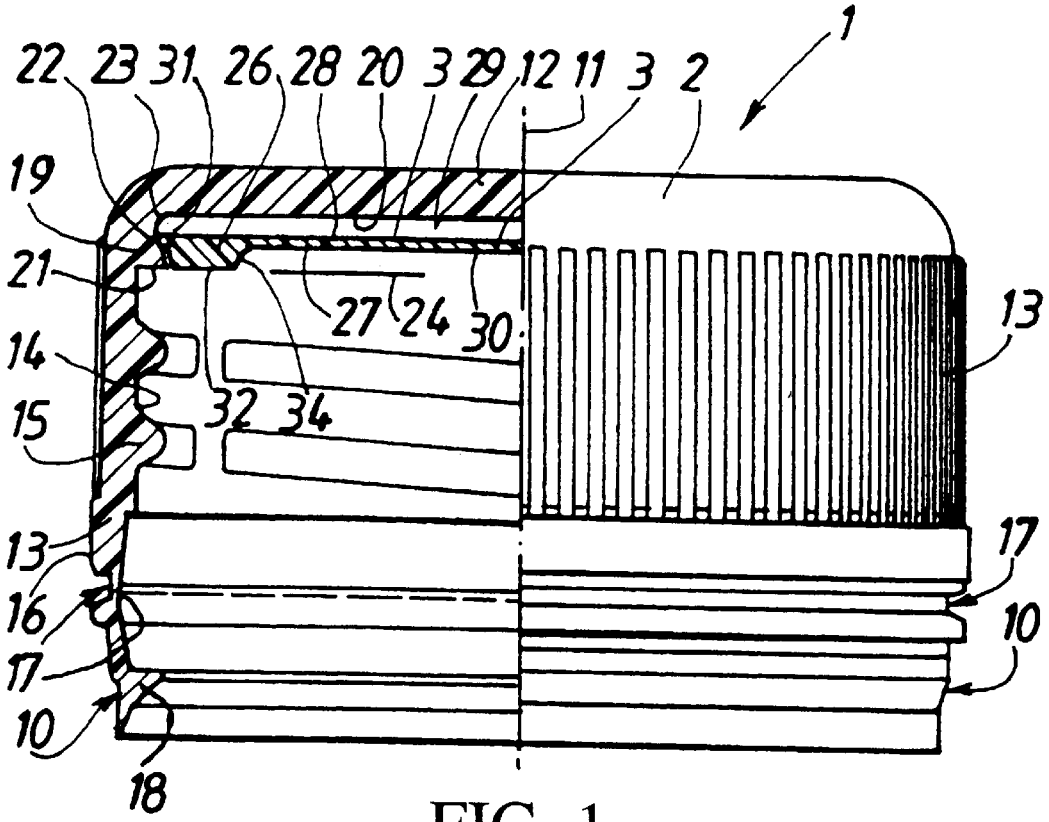
FIGS. 1 and 2 are two schematic views in axial section of two variants of cap according to the invention, comprising an added fluid seal and a tamperproof ring.

The Figures show a cap with fluid seal 1 comprising, on the one hand, a cap 2 proper and, on the other hand, a fluid seal 3 added in the cap 2.

The cap with seal 1 is intended to be mounted and tightened on the neck 4 of a container shown partially.

Depending on the applications in question, the container is made of plastics material or glass.

The container in question is typically a bottle for containing a drink.

The neck 4 has an inner face 5, an outer face 6, both generally cylindrical in form, a transverse face 7 joining the two faces 5 and 6 and being generally annular in form.

Finally, 8 denotes the more or less rounded, outer peripheral edge of the neck 4, between the outer face 6 and the transverse face 7.

The neck 4 of the recipient also comprises screw threads 9 intended for screwing the cap with seal 1.

Finally, and in the case of the cap with seal 1 comprising a tamperproof ring 10, the neck 4 of the container comprises an annular projection adapted to cooperate with the ring 10.

The neck 4 of the container which has just been described presents a general axis of symmetry or rotational axis 11. This axis is also a general axis of symmetry of the cap with seal 1.

The cap 2 is made of sufficiently rigid plastics material by injection, compression or otherwise.

The cap firstly comprises a transverse wall 12 forming the apex of the cap 2 when it is placed above the neck 4.

The cap 2 then comprises a skirt 13 adjoining the wall 12 on its periphery, of generally annular cylindrical form, extending over a certain axial length along axis 11.

The skirt 13 is provided on its inner face 14 with screw threads 15 complementary of the screw threads 9 of the neck 4.

According to one embodiment, the cap 2 finally comprises a tamperproof ring 10 adjoining the free edge 16 of the skirt 13 opposite the transverse wall 12.

The connection 17 between the skirt 13 and the tamperproof ring 10 adjoining the edge 16, is of lesser resistance, so as to be able to be fractured when the cap with seal 1 is opened for the first time.

Figure 2:
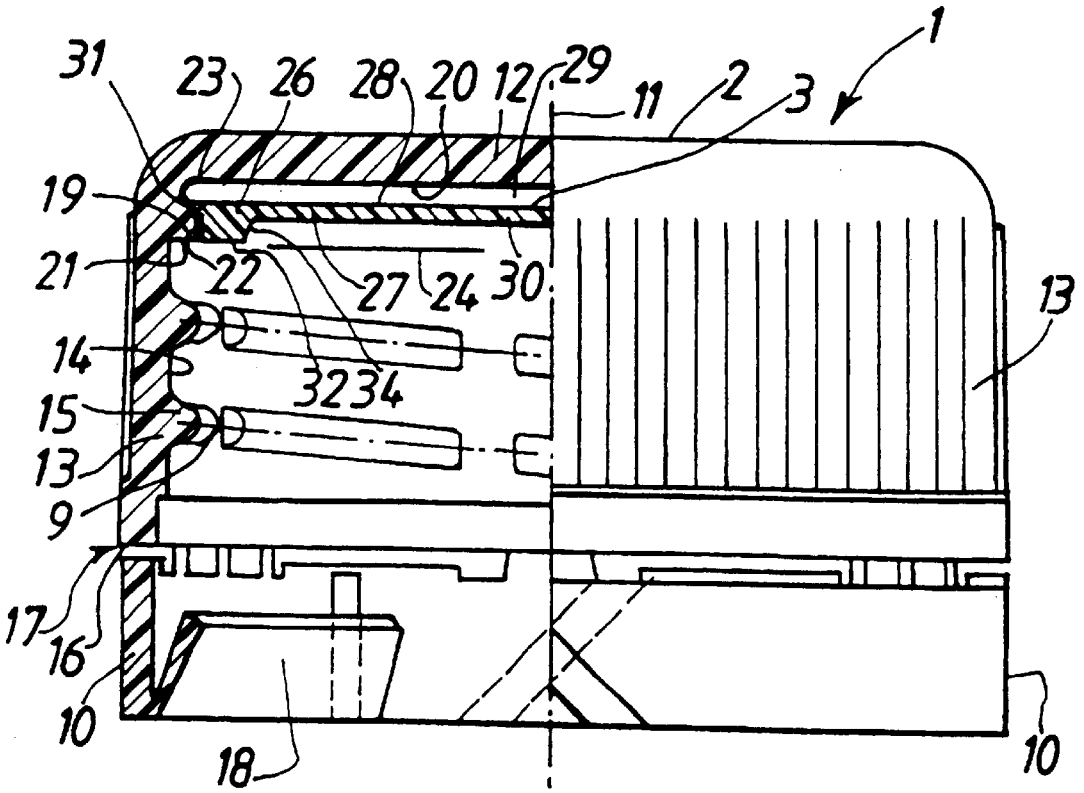
Figure 3:
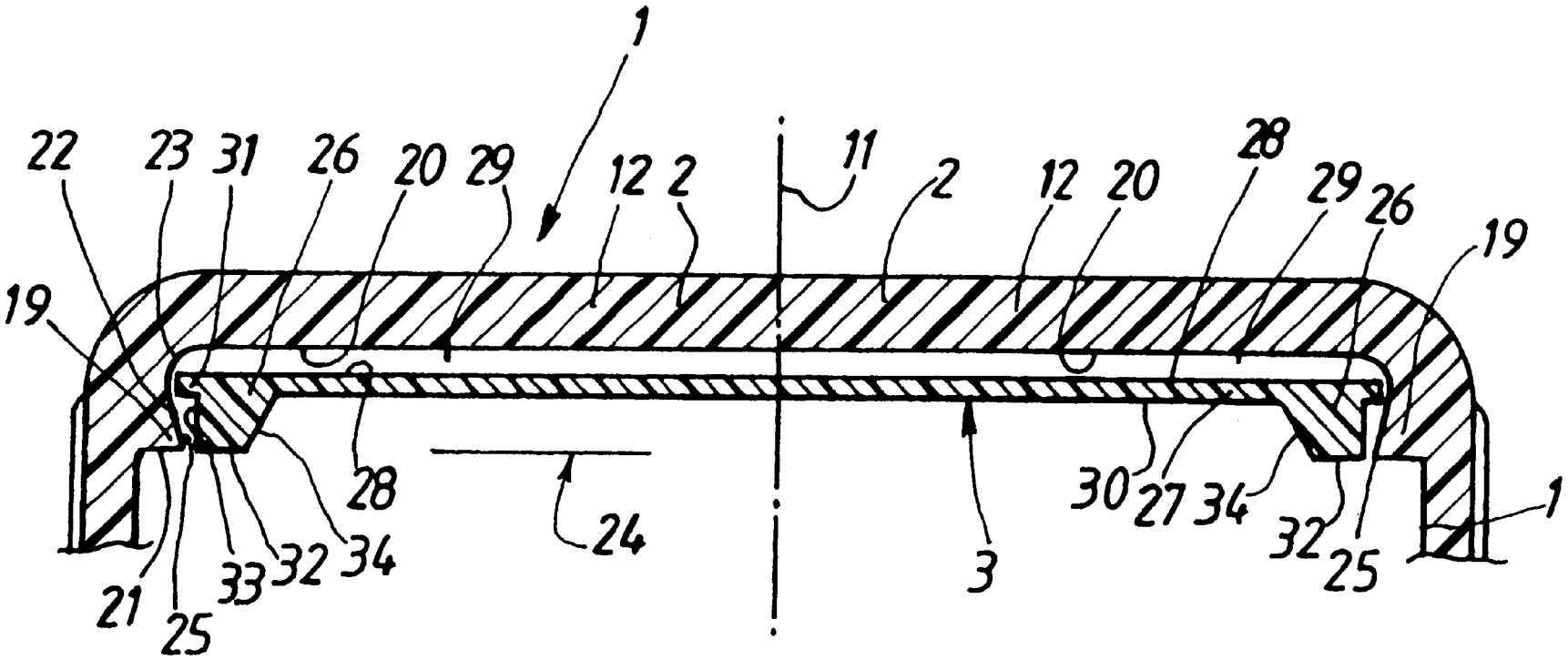
FIG. 3 is a partial view, on a scale larger than FIGS. 1 and 2, showing the fluid seal added in the bottom of the cap.

To that end, the connection 17 comprises, depending on the embodiments, frangible bridges separated by spaces empty of matter (FIG. 1) or cut-outs or a small thickness (FIG. 2). These embodiments are not exclusive of others.

On the other hand, the tamperproof ring 10 internally comprises a projection 18 adapted to interfere with the annular projection provided on the neck 4 of the container.

The projection 18 may also form the subject matter of different variant embodiments.

When the cap with seal 1 comprises such a tamperproof ring 10, the latter may also form the subject matter of other variants relative to its breakable character and to its attached character, after rupture of the connection 17, to the skirt 13.

For example, according to a variant embodiment, the tamperproof ring 10 is tranversely breakable and opens when the cap is opened for the first time (FIG. 2). According to another embodiment, the tamperproof ring 10 is not breakable transversely (FIG. 1).

When the tamperproof ring 10 is breakable, it may be provided to be connected to the skirt 13 by at least one non-frangible connection. In that case, the open tamperproof ring 10 remains hooked on the cap 2 proper.

In another variant, such a non-frangible connection is not provided and once the connection 17 is fractured, the tamperproof ring 10 is totally dissociated from the cap 2.

The cap 2 further comprises an inner annular projection 19. The projection 19 projects from the inner face 14 of the skirt 13. It is slightly spaced apart from the inner face 20 of the transverse wall 12.

The projection 19 participates in maintaining the fluid seal 3.

In an alternate embodiment the inner projection 19 presents in transverse cross section a generally V shape (in the present case upturned) comprising an arm 21, substantially transverse with respect to the axis 11 and an arm 22, slightly inclined with respect to axis 11, for example with an angle of the order of 20°.

The arm 22 is itself joined to the inner face 20 of the transverse wall 12 by a rounded portion 23.

The arms 21, 22 are joined by an edge or a free face 25. This edge or this face, which is annular, defines, towards the transverse wall 12, a narrowed opening 24.

It will be noted here that the difference in diameter between the opening 24 and the inclined arm 22 in the vicinity of the rounded portion 23 is fairly small and allows the positioning and maintenance of the fluid seal 3. Furthermore, the bottom of the cap 2 limited peripherally by the arm 22 and the rounded portion 23 forms a sort of chamber used for the compression of the seal 3 when the latter is compressed further to the tightening on the neck 4.

In the embodiment in question, the inner face 20 of the transverse wall 12 is planar.

The fluid seal 3 is likewise made of plastics material, the latter being, however, capable of being elastically deformed.

This seal 3 is made separately from the cap 2, by injection, compression, or otherwise.

The seal 3 comprises, in the first place, an elastically deformable peripheral bead 26, with which the neck 4 of the container can cooperate.

The seal 3 comprises, in the second place, a transverse wall 27 on the periphery of which the bead 26 is located.

The seal 3 comprises in the third place a peripheral shoulder 31 to which we will return hereinafter.

The fluid seal 3, once made, is added in the cap 2. It is maintained associated with the cap by means of the projection 19 cooperating with the shoulder 31. In this situation, a space 29 is made between the inner face 20 of the transverse wall 12 and the opposite face 28. When the cap with fluid seal 1 is mounted and tightened on the neck 4, the seal 3 may be housed in the space 29 in question, the latter disappearing wholly or partly. This space 29 is formed by the chamber of the bottom of the cap, as has been mentioned hereinabove.

Figure 4:
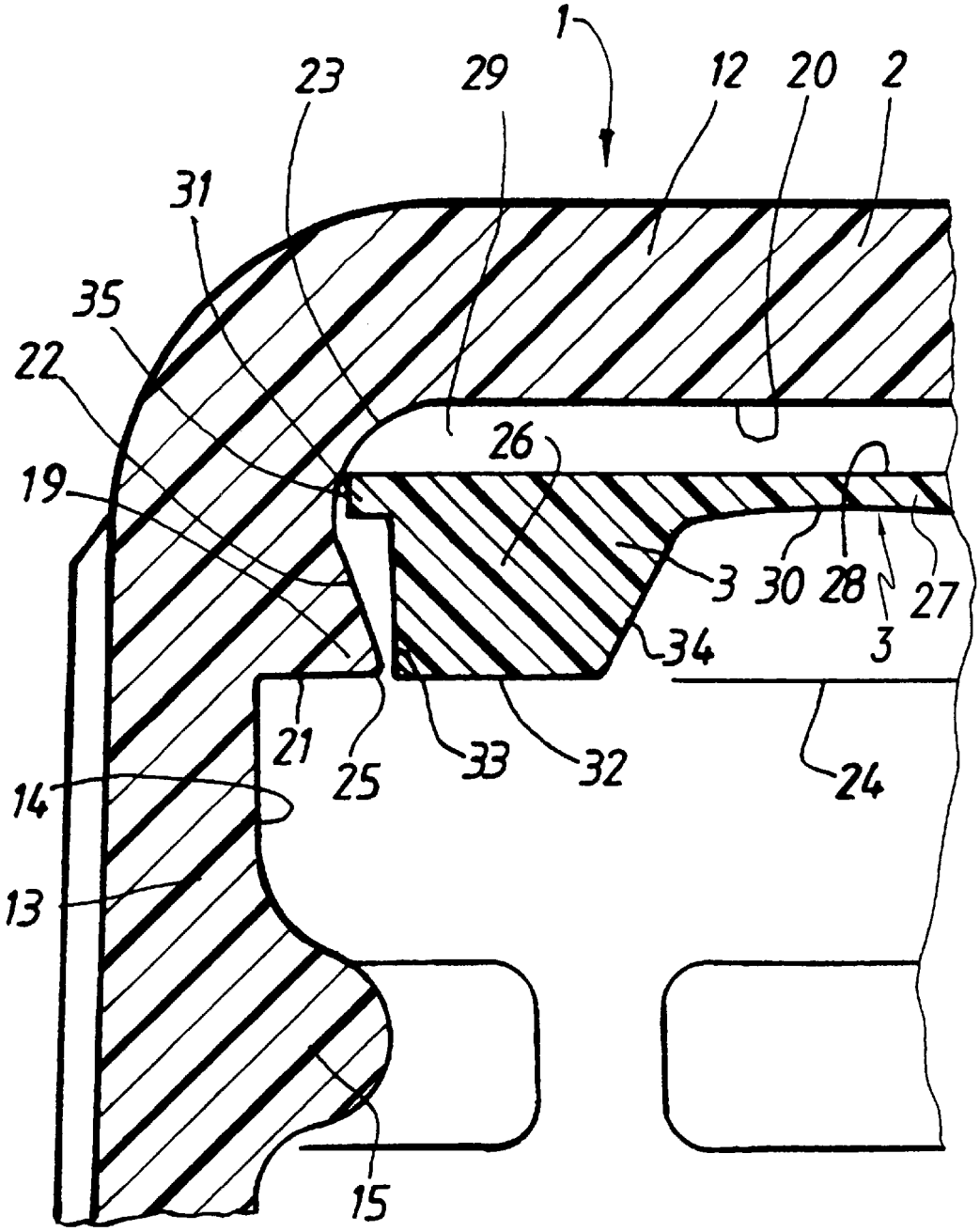
FIGS. 4 and 5 are two partial views, on a scale larger than FIG. 3, showing the added fluid seal respectively in place in the cap before tightening by the neck of the container and after tightening.
Figure 5:
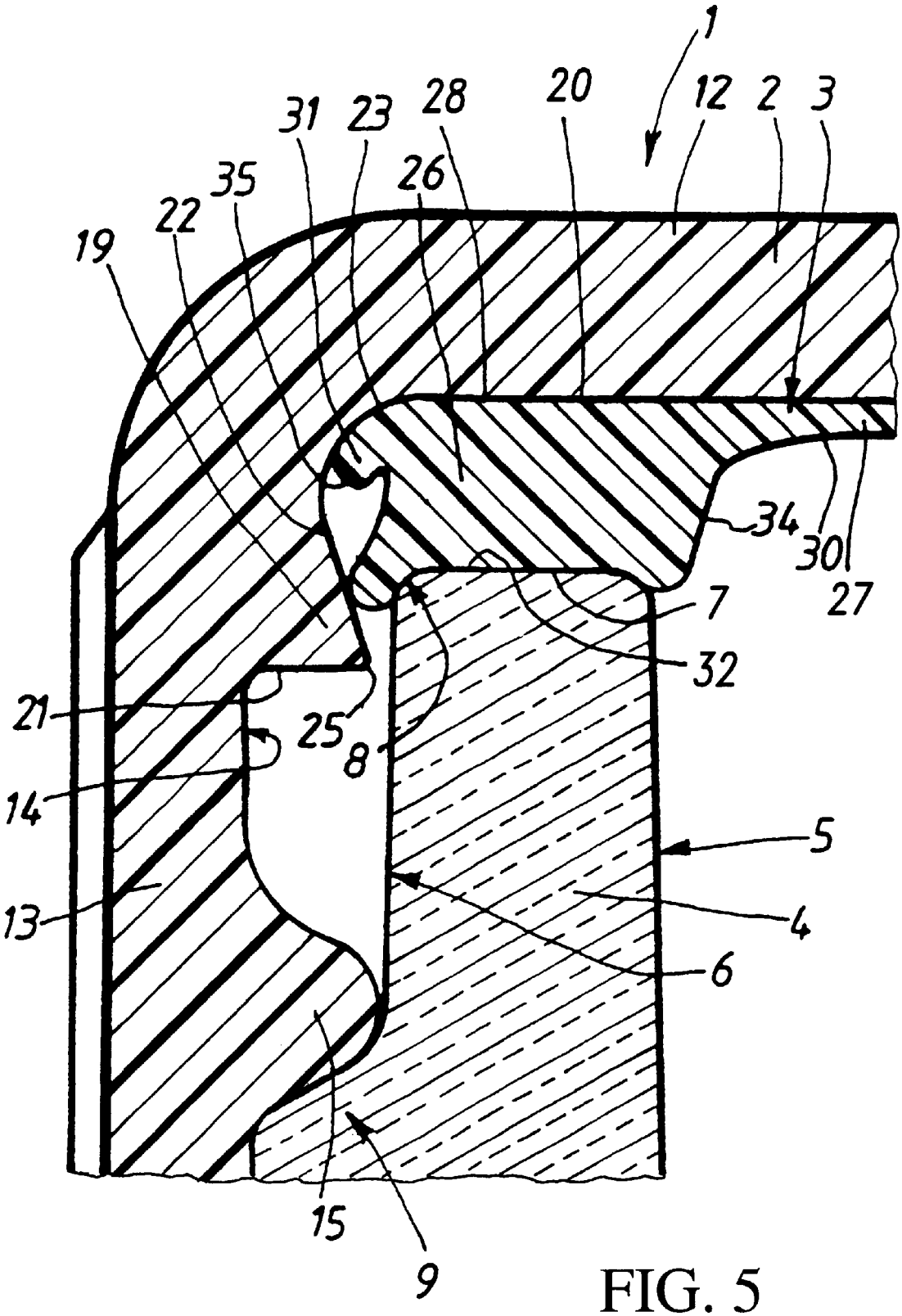

For the assembly of the fluid seal 3 in the cap 2, the seal 3 is forced to pass beyond the projection 19 via the narrowed opening 24, which is rendered possible further to the suppleness and weakness of the axial thickness of the shoulder 31. Once this forced passage is effected, the seal 3 is maintained in a situation which can be qualified as shouldered but floating, clearly visible in FIG. 4. The shoulder 31 has in that case resumed the configuration that it presented before the forced passage.

The fluid seal 3 will now be described more especially when it is at rest, shouldered but floating, i.e. when the cap with seal 1 is not yet mounted or at least not yet tightened by the neck 4 of the container.

In this situation, the face 28 of the transverse wall 27 of the fluid seal 3 is substantially planar. This is also true at the level of the bead 26. This configuration follows from the very process of manufacture of the seal (plane of mould). The bead 26 projects on that side of the face 30 of the seal 3 intended to be turned towards the neck 4 of the container.

Furthermore, the shoulder 31, which is annular, surrounds the bead 26 on the outside and is disposed in line with the transverse wall 27. This shoulder 31 is intended to cooperate with the projection 19, more precisely its inclined arm 22. This shoulder 31 is supple, with a thickness to allow easy assembly by force in the opening 24. The fluid seal 3 is therefore maintained in the cap 2 so as not to be dissociated therefrom in untimely manner.

Naturally, the annular diameter of the shoulder 31 is in relation with the annular diameter between the narrowed opening 24 and the large diameter of the space 29 at the place where the arm 22 is joined to the rounded portion 23.

Further to the process of manufacture of the seal employed, the outer lateral face 35 of the shoulder 31 is cylindrical or slightly truncated, the large base lying towards face 28.

Once the fluid seal 3 is mounted in the cap 2, the face 32 of the bead 26 placed in a transverse plane with respect to the axis 11 and opposite the face 28 is disposed substantially in the plane of the arm 21 of the projection 19.

Figure 9:
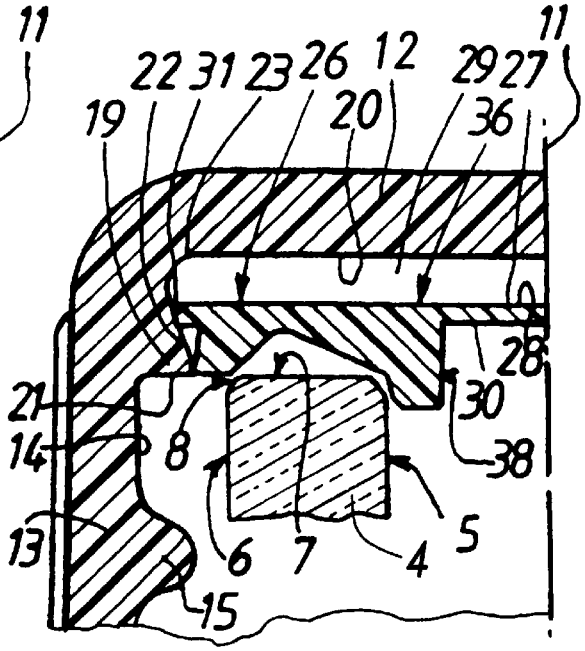
FIG. 9 is an enlarged partial cross-sectional view of a variation of the embodiment shown in FIG. 8 in which one of the beads includes an extension.
Figure 10:
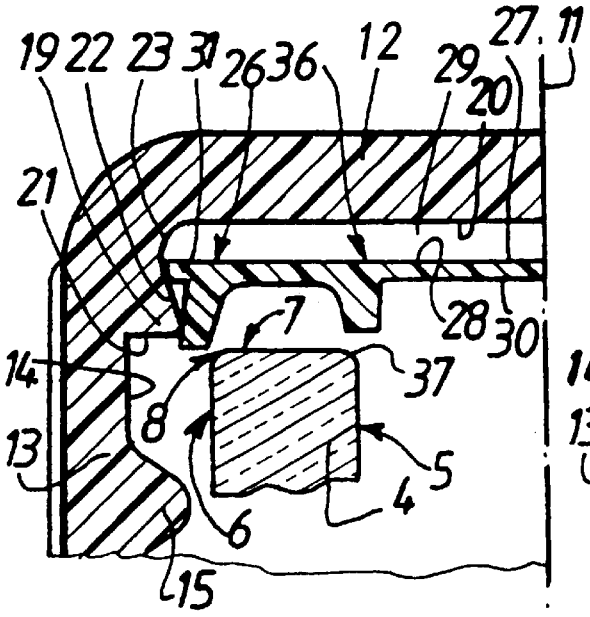
FIG. 10 is an enlarged partial cross-sectional view showing two annular beads for the fluid seal which are a variation of the structure shown in FIG. 7.
Figure 11:
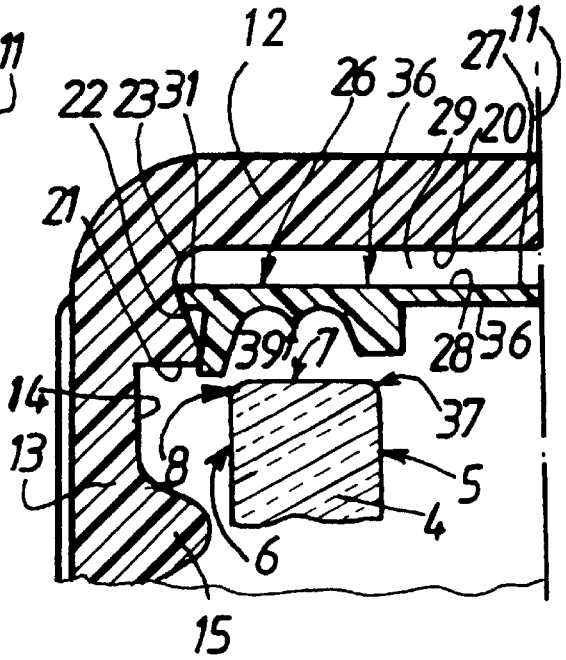
FIG. 11 is an enlarged partial cross-sectional view showing a further variation for an annular bead structure for the fluid seal of the present invention in the form of an inverted.

The face 32 of the bead 26 may be located slightly beyond the plane of the arm 21, on the side opposite the transverse wall 12 (FIGS. 9 to 11).

The space 29 previously mentioned is such that it is adapted in the first place to allow the appropriate deformation of the fluid seal 3 further to the assembly and tightening of the cap with seal 1 on the neck 4 of the container.

On the other hand and moreover, the space 29 is adapted to allow the application and abutment of the fluid seal 3, by its face 28, against the inner face 20 of the cap 2, once the cap with seal 1 is mounted and tightened on the neck 4. In the embodiment considered here, these two faces 20, 18 are principally or substantially planar.

In the embodiment in question, the bead 26 presents, in transverse cross section, a general V-shape with truncated or rounded apex.

This bead 26 is outwardly limited by a face 33, substantially cylindrical or truncated corresponding substantially to the opening 24. The bead 26 is inwardly limited by a face 34 having substantially a truncated shape. The diameter of this truncated cone nearest the wall 27 is the small diameter while the large diameter is intended to face the neck 4 of the container. Consequently, the bead 26 and the shoulder 31 are oriented inclined in the same direction.

In the embodiment which has just been described, the fluid seal 3 comprises one single bead 26.

However in other possible embodiments, the fluid seal 3 also comprises a second annular bead, placed inside the first bead 26 and slightly spaced apart therefrom radially.

Once the cap with seal I is mounted and tightened on the neck 4 of the container, the fluid seal 3 is deformed, comparatively to its rest situation. This deformation is such that the fluid seal 3 is applied in abutment on the inner face 20 of the cap 2. On the other hand, the bead 26—as the case may be the second bead when the latter is provided—is crushed and deformed by the free end part of the neck 4. As has been indicated hereinabove, the bottom of the cap 2 forms a chamber for the compression of the seal 3.

It should be noted that the cap 2 proper is adapted not only to receive an added seal such as 3, shouldered and floating once mounted, as described hereinabove, but also, alternately and possibly, a seal made in situ.

Consequently, the cap 2 is in that respect polyvalent. Symmetrically, the seal 3 may be added on different shapes of shells of cap 2.

FIGS. 6 to 11 show different non-limiting variants of forms of seal 3.

Figure 6:
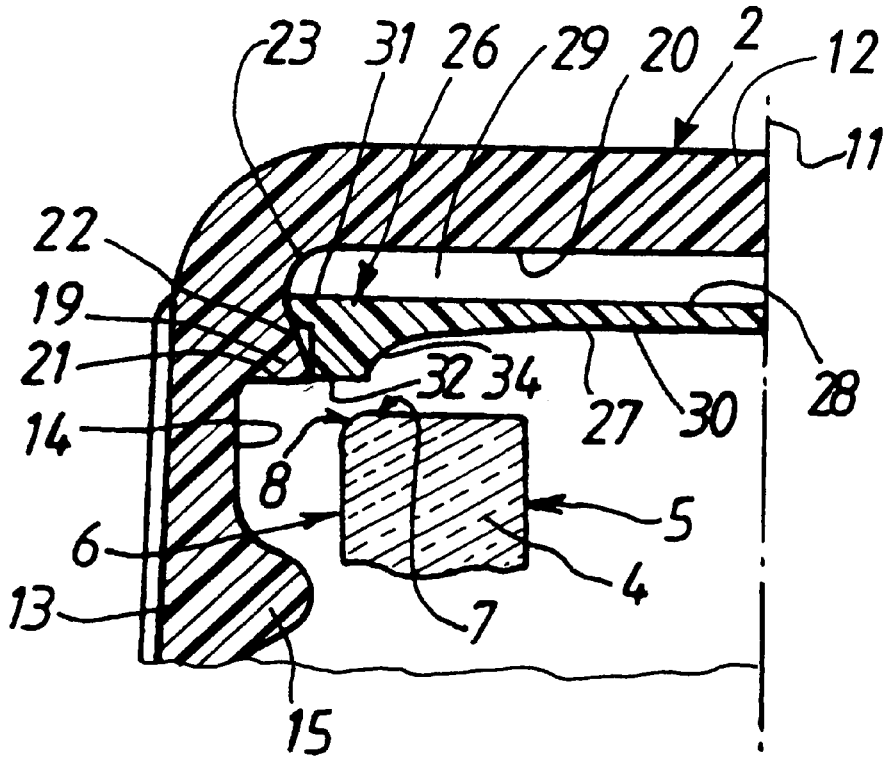
FIG. 6 is an enlarged partial cross-sectional view illustrating a first embodiment of inner annular bead associated with the fluid seal of the present invention.

In the case of FIG. 6, the face 34 is strongly inclined on the axis 11 and rounded towards the wall 27. The bead 26 is applied towards the edge 8.

Figure 7:
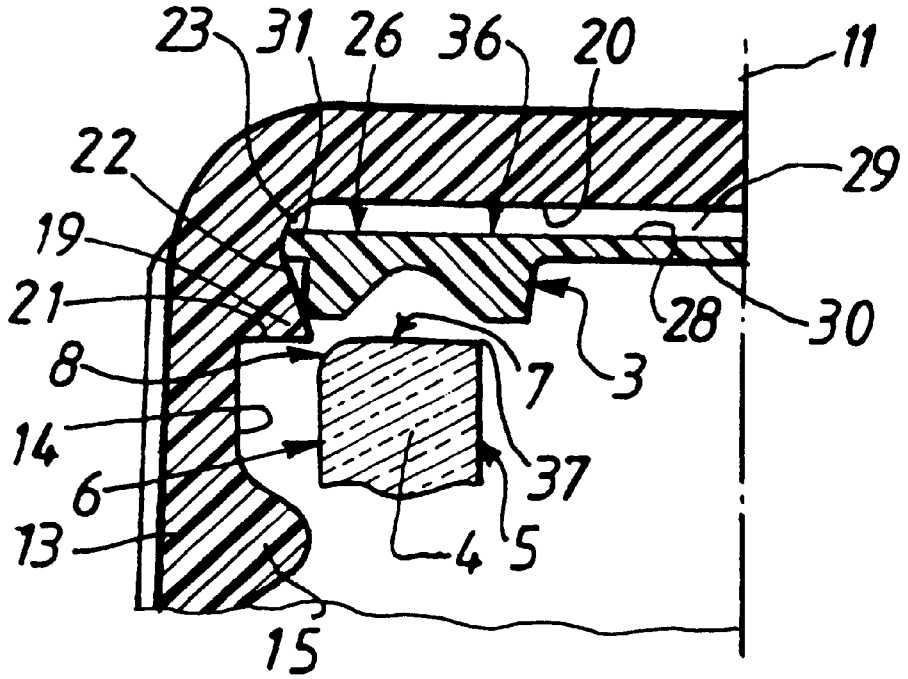
FIG. 7 is an enlarged partial cross-sectional view illustrating first and second concentric sealing beads for the fluid seal of the present invention.

In the case of FIG. 7, there are provided a first bead 26 and a second bead 36 placed inside the first bead 26 and spaced apart therefrom radially. The two beads 26 and 36 are disposed substantially symmetrically with respect to each other, the assembly having the general form of a pseudo W. The bead 26 is deformed by the edge 8. The bead 36 is deformed by the opposite edge 37.

Figure 8:
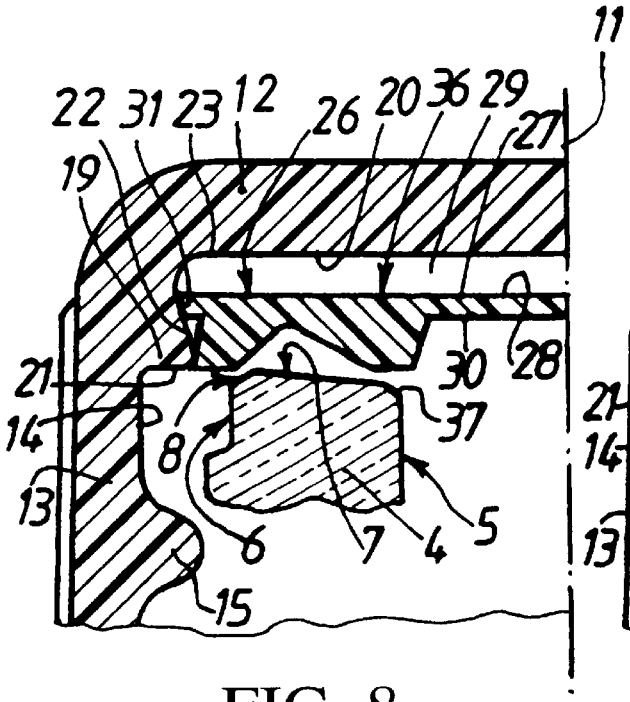
FIG. 8 is an enlarged partial cross-sectional view showing two annular beads which are disymmetrical.

FIG. 8 shows a variant of the embodiment shown in FIG. 7, in which the two beads 26 and 36 are disymmetrical. In the present case, the bead 36 is wider than bead 26.

FIG. 9 shows a variant of the embodiment shown in FIG. 8, in which the bead 36 comprises an extension 38 directed axially, opposite the wall 27, applied against the inner face 5 of the neck 4.

FIG. 10 shows a variant of the embodiment shown in FIG. 7. Here, the two beads 26 and 36 are clearly more spaced apart than in the case of FIG. 7, their shape being more that of an upturned U than an upturned V.

FIG. 11 is a variant of FIG. 10 in which a third bead 39 is taken between the beads 26 and 36.

What is claimed is:

1. A cap for sealing an opening in a neck of a container, the cap including;

a body having a top wall and depending annular skirt, said top wall having a generally planar inner transverse wall and said skirt having an inner annular projection spaced from said inner transverse wall, a fluid seal having a transverse wall having an outer annular shoulder and inner and outer faces, an inner annular bead projecting from said inner face and said outer face being substantially planar and being spaced and in opposing relationship to said inner transverse wall of said body, said fluid seal resting on said inner annular projection of said body spaced from said inner transverse wall so as to define a space between said seal and said inner transverse wall, said transverse wall of said fluid seal having a diameter greater than a diameter of said inner transverse wall of the cap whereby, when said fluid seal is pushed into said space when the cap is placed on the neck of a container and tightened, said outer annular shoulder cooperates with said inner annular projection of the cap to form a fluid tight seal.

2. The cap of claim 1, in which a face of a projecting free edge of said inner annular bead of said seal is disposed substantially in a plane of an inwardly projecting free edge of said inner annular projection of said body of the cap.

3. The cap of claim 1, in which the space between the inner transverse wall of the cap and the fluid seal is such as to cause deformation of the fluid seal upon assembly and tightening of the cap on the neck of the container.

4. The cap of claim 1, in which the inner annular bead has a transverse cross section generally in a form of a cross section selected from a group of cross sections consisting of a V, a U and a W.

5. The cap of claim 1, in which said inner annular bead includes an outer cylindrical face of a diameter corresponding substantially to an opening defined by the inner annular projection of the cap, and an inner substantially truncated face which tapers inwardly toward said transverse wall of said fluid seal.

6. The cap of claim 1, in which said fluid seal includes a second annular bead inwardly concentric with respect to said inner annular bead and spaced therefrom.

7. The cap of claim 1, in which said inner annular projection of said body includes a first annular surface extending substantially perpendicular to a rotational axis of said body and a second surface which is transversely inclined with respect to the rotational axis.

8. The cap of claim 1, including a tamper indicating ring adjoining a free edge of said depending annular skirt and connected thereto by frangible sections which fracture when the cap is initially removed from the neck of the container.

9. The cap of claim 8, in which said tamper indicating ring is frangible transversely in a least one section when the cap is initially removed from the neck of the container.

10. The cap of claim 8, in which the tamper indicating ring is not frangible transversely.

11. The cap of claim 8, in which said frangible sections are selected from a group of sections consisting of bridges, cut-outs and wall segments of reduced thickness.

12. A combination container and cap for sealing an opening in a container, the combination including; a container having a neck with an upper rim defining an opening, the cap including; a body having a top wall and depending annular skirt, said top wall having a generally planar inner transverse wall and said skirt having an inner annular projection spaced from said inner transverse wall, said cap also having a fluid seal having a transverse wall having an outer annular shoulder and inner and outer faces, an inner annular bead projecting from said inner face and said outer face being substantially planar and being spaced and in opposing relationship to said inner transverse wall of said body, said fluid seal resting on said inner annular projection of said skirt spaced from said inner transverse wall of said body so as to define a space between said seal and said inner transverse wall, said transverse wall of said fluid seal having a diameter greater than a diameter of said inner transverse wall of said body whereby when said fluid seal is pushed into said space when said cap is placed on said neck of said container and tightened, said outer annular shoulder cooperates with said inner annular projection of said cap to form a first fluid tight seal with a second seal provided between said inner annular bead of said fluid seal and said rim of said neck of said container.

13. A combination container and threaded cap including; a container having a threaded neck defining an opening into said container, said neck having an upper rim, the threaded cap including;

a body having a top wall and depending annular skirt, said top wall having a generally planar inner transverse wall and said skirt having an inner annular projection spaced from said inner transverse wall, a tamper indicating ring connected to and extending from a lower edge of said depending annular skirt, a fluid seal having a transverse wall having an outer annular shoulder and inner and outer faces, an inner annular bead projecting from said inner face and said outer face being substantially planar and being spaced and in opposing relationship to said inner transverse wall of said body, said fluid seal resting on said inner annular projection of said body spaced from said inner transverse wall so as to define a space between said seal and said inner transverse wall, said transverse wall of said fluid seal having a diameter greater than a diameter of said inner transverse wall of said body whereby when said fluid seal is pushed into said space when said cap is placed on said neck of said container and tightened, said outer annular shoulder cooperates with said inner annular projection of said body to form a first fluid tight seal, and said inner annular bead of said seal is engaged by said rim of said neck to thereby form a second fluid tight seal.

14. The cap of claim 13, in which said tamper indicating ring is joined to said skirt by at least one non-frangible section.

15. A process for making a cap for sealing an opening in a neck of a container including;

forming the cap of a plastic material so as to have a body with a top wall and depending annular skirt wherein the top wall has a generally planar inner transverse wall and the skirt has an inwardly extending annular projection spaced from the inner transverse wall;

forming a seal of a plastic material so as to have a transverse wall having inner and outer faces and from which extends an outer pliable annular shoulder and an inner annular bead which projects from the inner face and so that the outer face is substantially planar;

urging the seal into the body of the cap within the annular skirt so that the outer face is spaced in opposing relationship to the inner transverse wall of the cap, and so that the shoulder of the seal rests on the inner annular projection of the cap and such that a space is created between the seal and the inner transverse wall in which the seal is movably compressible.

* * * * *